US006183196B1

(12) United States Patent
Fujinaka

(10) Patent No.: US 6,183,196 B1
(45) Date of Patent: Feb. 6, 2001

(54) BLOWER

(75) Inventor: Hiroyasu Fujinaka, Moriguchi (JP)

(73) Assignee: Matsushita Electric Industrial Co., Ltd. (JP)

( * ) Notice: Under 35 U.S.C. 154(b), the term of this patent shall be extended for 0 days.

(21) Appl. No.: 09/311,357

(22) Filed: May 13, 1999

(30) Foreign Application Priority Data

May 14, 1998 (JP) ..... 10-130894

(51) Int. Cl.[7] ..... F04D 29/66

(52) U.S. Cl. ..... 415/208.5; 415/119; 415/211.1; 415/214.1; 415/914; 416/247 R

(58) Field of Search ..... 415/119, 186, 415/187, 208.3, 208.5, 209.1, 211.1, 214.1, 220, 223, 914; 416/247 R

(56) References Cited

U.S. PATENT DOCUMENTS 5,288,203 2/1994 Thomas .
5,292,088 * 3/1994 Lemont ..... 416/247 R
5,393,197 2/1995 Lemont et al. .
5,407,324 4/1995 Starnes, Jr. et al. .
5,707,205 * 1/1998 Otsuka ..... 415/119

* cited by examiner

*Primary Examiner*—Christopher Verdier
(74) *Attorney, Agent, or Firm*—Parkhurst & Wendel, L.L.P.

(57) ABSTRACT

In a blower in which air is sucked to the inside through slits formed in an annular wall, the width w and the number of slits are so set that an air flow of 20 to 40% of the maximum air flow is sucked through the slits in a state in which the static pressure is zero. By this configuration, the fan stall inhibiting effect due to the air flow through the slits and the energy loss due to the viscosity of air yielded in the slits are balanced, whereby the efficiency of the blower can be improved.

6 Claims, 11 Drawing Sheets

Fig.4

| No. | SLIT PORTION | | | | | CHARACTERISTICS (at 4300 rpm) | | |
|---|---|---|---|---|---|---|---|---|
| | SLIT WIDTH w | | NUMBER OF SLITS n | AIR FLOW RATE $Q_s$ | | MAXIMUM AIR FLOW $Q_{max}$ | MAXIMUM STATIC PRESSURE $P_{max}$ | MAXIMUM EFFICIENCY |
| | MAXIMUM (mm) | MINIMUM (mm) | | ($m^3$/min) | RATIO (%) | ($m^3$/min) | ($mmH_2O$) | (%) |
| 1 | 1. 50 | 1. 06 | 3 | 0. 14 | 27. 0 | 0. 51 | 5. 4 | 22. 4 |
| 2 | 1. 19 | 0. 85 | 4 | 0. 15 | 29. 5 | 0. 51 | 5. 4 | 23. 5 |
| 3 | 1. 36 | 0. 97 | 4 | 0. 18 | 35. 5 | 0. 51 | 5. 7 | 23. 9 |
| 4 | 1. 50 | 1. 06 | 4 | 0. 21 | 41. 7 | 0. 51 | 6. 0 | 23. 0 |
| 5 | 1. 50 | 1. 06 | 5 | 0. 24 | 48. 5 | 0. 49 | 5. 9 | 21. 5 |
| CONVENTIONAL | — | — | — | — | — | 0. 54 | 5. 4 | 18. 4 |

AIR FLOW VS. STATIC PRESSURE CHARACTERISTICS (at 4300 rpm)

AIR FLOW VS. FAN DRIVING FORCE CHARACTERISTICS (at 4300 rpm)

BLOWER

FIELD OF THE INVENTION

The present invention relates to a blower and a method for determining a slit shape for a blower.

BACKGROUND OR THE INVENTION

In recent years, high-density mounting of electrical circuits has been widely used as equipment is miniaturized and becomes electronic. Accordingly, because of the increase in heat density of the electronic equipment, a blower has been used for cooling the equipment.

For a conventional blower, as shown in FIG. 9, an annular wall 2 is formed so as to be spaced from the blade tip end of an axial fan 1, and the axial fan 1 rotates around a shaft 4 in a blowing state in which a motor 3 is energized, by which an air flow (air quantity per unit time) 5 directed from the suction side to the discharge side is generated.

However, in the aforementioned blowing state, the velocity of the air flow increases on the back pressure side of the blade tip end, and a low-energy zone due to the effect of an inter-blade secondary flow is produced on the blade trailing edge side where the air flow is converted into pressure energy. In this zone, loss is great, and the flow is liable to be separated. The air flow is separated from the blade surface, so that vortexes are produced in the separation region, by which turbulence noise is increased, and the noise level and the air flow vs. static pressure characteristics deteriorate.

This phenomenon is frequently found especially when a flow resistance (system impedance) is applied to the discharge flow side and when the occurrence of leakage vortexes at the blade tip end increases, by which the fan goes into a stalling state.

To solve this problem, in a blower disclosed in a prior application (Japanese Patent Application Laid-Open No. 10-18995) filedby the same applicant as that of this invention, a method has been disclosed in which air is sucked to the inside of the annular wall through slits formed in the annular wall in the blowing state to restrain leakage vortexes at the blade tip end and rotating stall, by which the air flow vs. static pressure characteristics are improved and the noise is reduced.

FIGS. 10*a* to 10*c* show a blower as disclosed in Japanese Patent Application Laid-Open No. 10-18995.

For this blower, slits 6 are formed in an annular wall 2 surrounding an axial fan 1. Specifically, annular plates $\mathbf{7}_1$, $\mathbf{7}_2$, $\mathbf{7}_3$, $\mathbf{7}_4$, $\mathbf{7}_5$ are laminated with spacers 8 being held therebetween, and a slit 6 is formed between the adjacent annular plates of the annular plates $\mathbf{7}_1, \ldots \mathbf{7}_5$.

FIG. 11 shows the characteristics of this blower at the same rotational speed.

The blower with slits, in which air is allowed to flow in from the outer periphery of the annular wall 2, is superior to the conventional (no-slit) blower of the same size in terms of air flow and noise at high pressures. However, the blower with slits has a problem in that the air flow at low pressure is slightly small, and the power (a value obtained by multiplying driving torque by rotational speed, hereinafter referred to as a fan driving force) at the time when the fan is driven at the same rotational speed is high, so that the fan static pressure efficiency (a value obtained by multiplying static pressure by air flow and dividing by fan driving force) is decreased.

SUMMARY OF THE INVENTION

An object of the present invention is to reduce noise and to improve the energy efficiency of blower.

The blower and the method for determining a slit shape in accordance with the present invention realize reduced noise and improved energy efficiency of blower by properly setting the width and the number of the slits in a blower in which the slits are formed in an annular wall and air is sucked into the inner peripheral portion of the annular wall through the slits as a fan rotates.

According to the present invention, the efficiency of the blower can be enhanced, and a decrease in consumed energy and an increase in cooling capacity of an equipment can be realized.

The blower in accordance with the present invention is a blower in which an annular wall is spaced from the blade tip end of a fan, a slit for communication between the inner and outer peripheral portions of the annular wall is formed at a portion opposed to the blade tip end of the annular wall, and air is sucked to the inner peripheral portion of annular wall through the slits as the fan rotates. The width and the number of slits are so set that an air flow of 20 to 40% of the maximum air flow is sucked through the slits in a state in which the static pressure is zero.

Also, the blower in accordance with the present invention is characterized in that in the case where the width of the slit does not change in the radial direction, when the viscosity of air is taken as $\eta$, the inside diameter of annular wall as D, the radial-directional length of slit as L, the width of slit as a constant value of w, the number of slits as n, the maximum static pressure of blower as $P_{max}$, and the maximum air flow of blower as $Q_{max}$, the width and the number of slits are so set that the relationship between these particulars satisfies the following condition:

$$4.0 \le \frac{\pi \cdot D \cdot n \cdot w^3 \cdot P_{\max}}{12\eta \cdot L \cdot Q_{\max}} \le 13.0$$

Further, the blower in accordance with the present invention is characterized in that in the case where the width of slit changes in the radial direction, when the viscosity of air is taken as $\eta$, the inside diameter of annular wall as D, the radial-directional length of slit as L, the width of slit at a distance 1 from the inner periphery of the slit as w(1), the number of slits as n, the maximum static pressure of blower as $P_{max}$, and the maximum air flow of blower as $Q_{max}$, the width and the number of slits are so set that the relationship between these particulars satisfies the following condition:

$$4.0 \le \frac{\pi \cdot D \cdot n \cdot P_{\max}}{12\eta \cdot Q_{\max} \int_0^L \frac{1}{w(l)^3} dl} \le 13.0$$

Still further, the method for determining a slit shape of a blower in accordance with the present invention is characterized in that, in the above-described blower, the shape of the slit is so determined that an air flow of 20 to 40% of the maximum air flow is sucked through the slits, so that the aforementioned equations describing the relationship between the particulars are satisfied.

BRIEF DESCRIPTION OF THE DRAWINGS

FIG. 4 is a comparison table showing experimental results;

DESCRIPTION OF THE EMBODIMENTS

An embodiment of the present invention will be described below with reference to FIGS. 1 to 8.

Figure 1A:
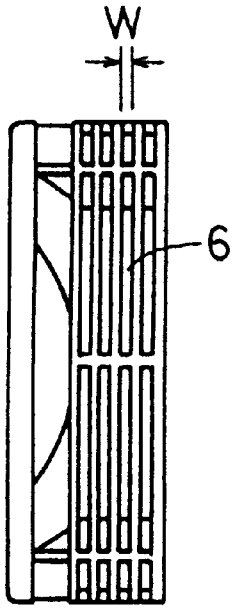
FIGS. 1*a*, 1*b*, and 1*c* are a front view, a side view, and a sectional view of an axial blower in accordance with the present invention, respectively.
Figure 1B:
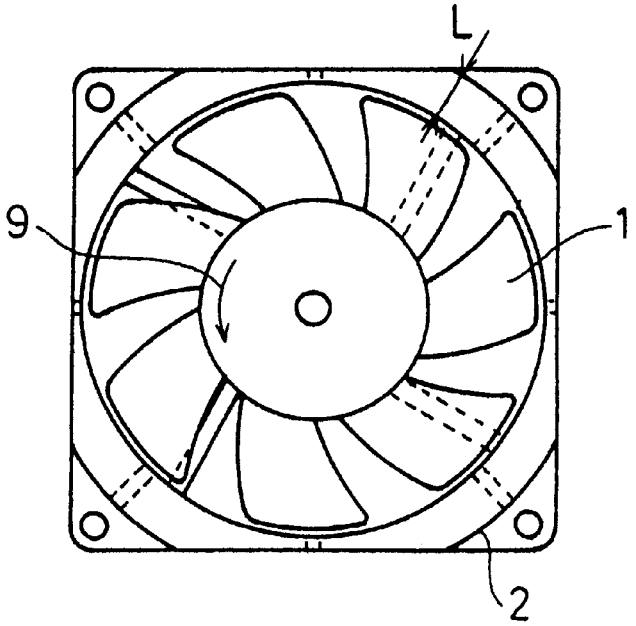
Figure 1C:
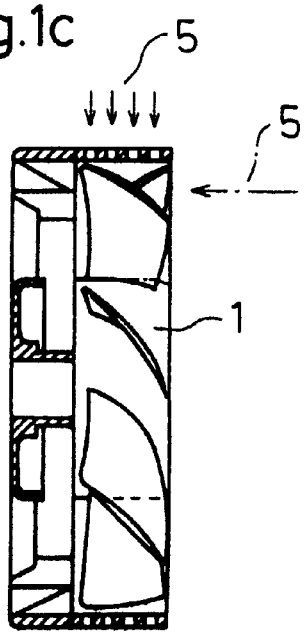

FIGS. 1*a*, 1*b*, and 1*c* show a blower with slits in accordance with the present invention.

As shown in FIG. 1*c*, an annular wall 2 is formed with slits 6 for communication between the inner and outer peripheral portions at a portion opposed to the blade tip end of an axial fan 1. Also, the width w of the gap of each of the slits 6 is continuously changed in accordance with a length L in the radial direction of every portion of the annular wall 2 so as to meet the condition wherein the width w of the gap of each of the slits is expressed as follows, where the length in the radial direction of every portion of the annular wall 2 is L, $$\frac{w^3}{L} = \text{Const} \tag{1}$$

to make the inflow resistance at every portion approximately equal over the whole circumference.

A negative pressure is produced on the back pressure side at the blade tip end by rotating the axial fan 1, and by a difference in air pressure between the inner periphery and the outer periphery of annular wall, the inflow of an air flow 5 directed from the slit to the inside of annular wall is produced. By setting the width w of the gap of each of the slits 6 at a proper value, the air flow flowing in through the slits 6 forms a laminar flow, so that a leakage vortex 7 flowing from the positive pressure side to the back pressure side at the blade tip end is inhibited. Therefore, the separation of air flow on the back pressure surface is eliminated, by which the air flow vs. static pressure characteristics are improved and the noise is reduced.

However, although the blower in which air is sucked from the outer periphery of annular wall as described above performs better than a conventional blower at high load time when the static pressure is high, it has a tendency such that the air flow is inversely decreased, and the fan static pressure efficiency is also decreased when the static pressure is low.

In the present invention, attention has been paid to the viscosity loss of air flow yielded at the slit portion as the cause for this, and the viscosity loss yielded at this portion has been elucidated theoretically, and conditions for enhancing the efficiency of blower have been derived by various experiments.

Here, the viscosity loss yielded at the slit portion will be explained with reference to FIG. 2.

Figure 2:
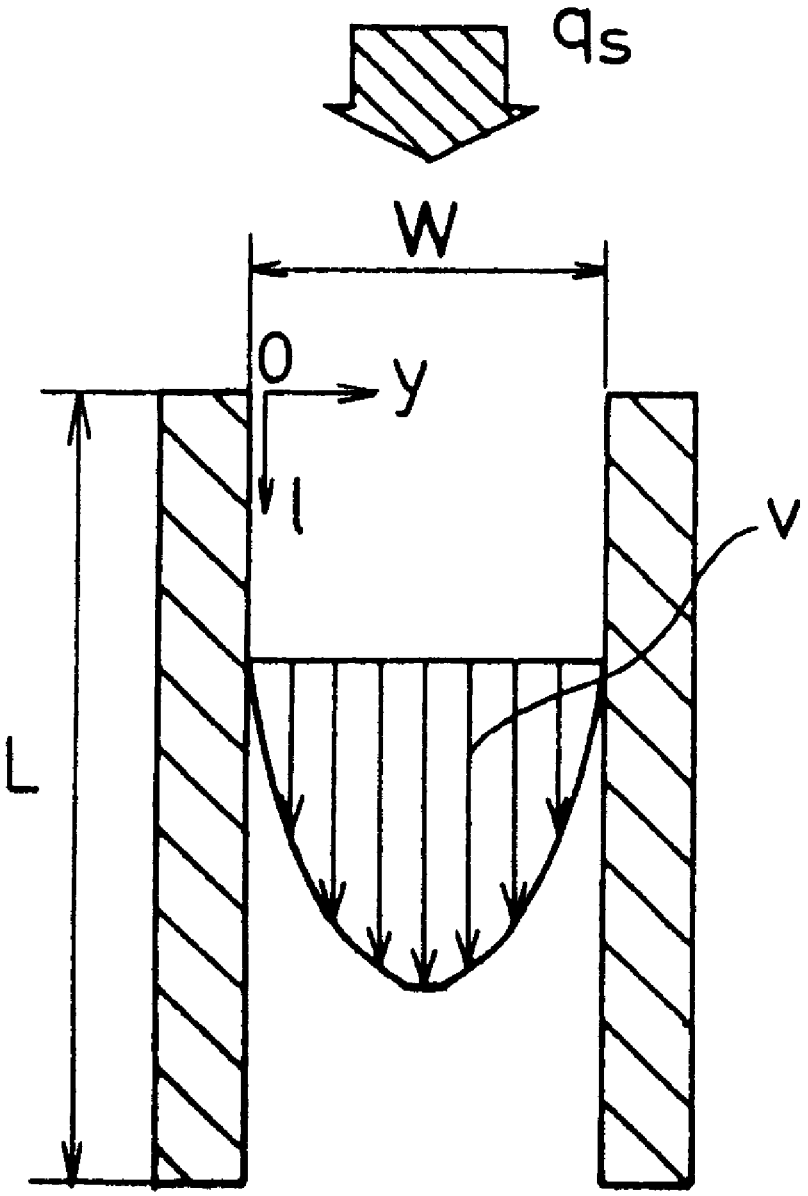
FIG. 2 is a sectional view showing an air flow in a slit.

FIG. 2 shows an air flow at the slit portion.

When the width w of slit is assumed to be sufficiently narrow as compared with the length L in the radial direction of the annular wall 2, and the inertia force and volume force of air and the turbulence of air flow at the inlet and outlet of slit are neglected, the distribution of a velocity v of air flow in the slit shows a parabolic form as shown in FIG. 2 when a difference in air pressure Δp is produced between the inner periphery and the outer periphery of annular wall due to the rotation of the fan.

Taking the slit length in the radial direction as L, the viscosity of air as η, and the distance yin the width direction of slit as shown in FIG. 2, the velocity v of air flow is expressed as $$v = \frac{1}{2\eta}\cdot\left(-\frac{\Delta P}{L}\right)\cdot(y^2 - wy) \tag{2}$$

By integrating this equation from y=0 to y=w, the flow rate $q_s$ of air flowing in through a unit slit for unit time is expressed as $$q_3 = \int_0^w v\,dy = \frac{w^3}{12\eta}\cdot\frac{\Delta P}{L} \tag{3}$$

If Δp, $w^3/L$, and η are assumed to be constant, it is thought that the air of the same flow rate flows in at every slit. Therefore, taking the inside diameter of annular wall as D, and the number of slits as n, the total flow rate $Q_s$ of air flowing in for unit time is expressed as $$Q_3 = \pi\cdot D\cdot n\cdot q_3 = \frac{\pi\cdot D\cdot n\cdot w^3\cdot\Delta P}{12\eta\cdot L} \tag{4}$$

Therefore, if Δp and η are thought to be equal, the flow rate $Q_s$ of air flowing in for unit time is proportional to $w^3/L$ and the number of slits n. At this time, since an energy loss $W_{loss}$ due to viscosity (hereinafter, sometimes referred simply to as a viscosity loss) consumed in the slits for unit time is $\Delta p\cdot Q_s$, the viscosity loss $W_{loss}$ is expressed as $$W_{loss} = \Delta P\cdot Q_3 = \frac{\pi\cdot D\cdot n\cdot w^3\cdot\Delta P^2}{12\eta\cdot L} \tag{5}$$

That is to say, when the difference in air pressure Δp between inner and outer peripheries of annular wall is assumed to be constant, the viscosity loss $W_{loss}$ yielded at the slit portion is proportional to the flow rate $Q_s$ of air flowing in through the slits, and the flow rate $Q_s$ of air flowing in through these slits increases in proportion to $w^3/L$ and the number of slits n.

By eliminating Δp from Equation (4), Equation (5) can also be expressed as $$W_{loss} = \frac{12\eta \cdot L \cdot Q_s^2}{\pi \cdot D \cdot n \cdot w^3} \quad (6)$$

If the flow rate $Q_s$ of air flowing in through the slits is determined by a method in which, for example, the flow rate of air around the slit is measured, the energy loss $W_{loss}$ due to viscosity consumed in the slits of an actual blower can be calculated simply by using this equation.

Although the difference in air pressure Δp between inner and outer peripheries of annular wall has been assumed to be constant in the above description, actually, the difference in air pressure Δp between inner and outer peripheries of annular wall changes slightly depending on the flow rate $Q_s$ of air flowing in through the slits. Also, by the effect of pressure loss at the inlet and outlet of slit, the energy loss consumed in the slit becomes slightly higher than the aforementioned calculated value. However, the energy loss $W_{loss}$ due to viscosity consumed in the slits can surely be decreased by making $w^3/L$ and the number of slits n as small as possible and thereby decreasing the flow rate $Q_s$ of air flowing in through the slits.

However, if the width w of slit and the number of slits n are decreased too much, the effect of inhibiting fan stall, which is the most significant feature of the blower in which air is sucked from the outer periphery of annular wall, described before is lost. Actually, therefore, the inhibition of fan stall and the decrease in energy loss due to viscosity are conflicting features.

Figure 3A:
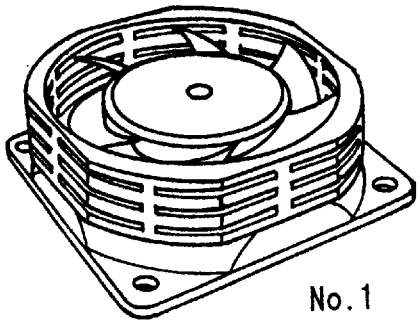
FIGS. 3*a* to 3*e* are perspective views of samples with slits.
Figure 3B:
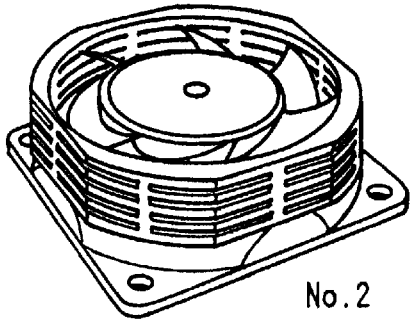
Figure 3C:
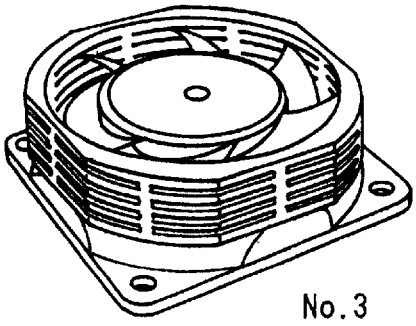
Figure 3D:
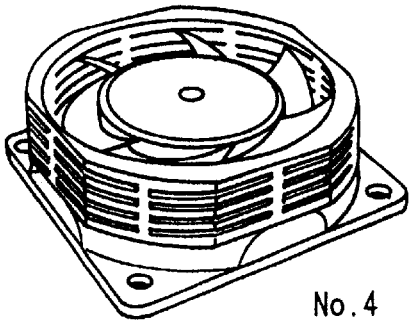
Figure 3E:
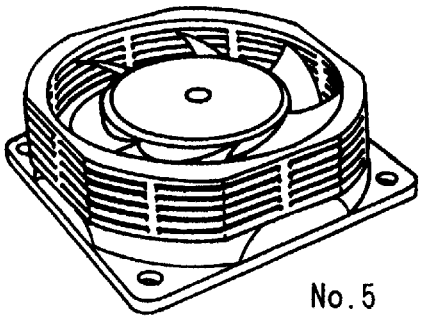
Figure 3F:
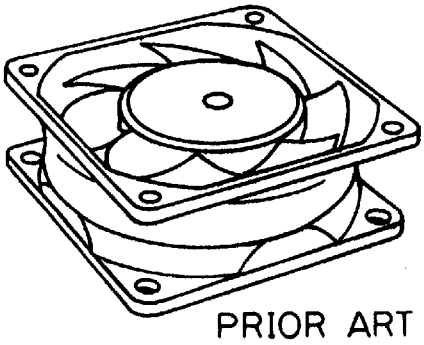
FIG. 3*f* is a perspective view of a conventional blower without slits.

Thereupon, in the present invention, to find the optimum point where two features of the inhibition of fan stall and the decrease in energy loss due to viscosity are balanced, five blowers of No. 1 to No. 5 shown in FIGS. 3*a* to 3*e*, in which the width w of slit and the number of slits n are changed based on the blower which is being mass-produced at present, were manufactured on an experimental basis, and the characteristics thereof were evaluated. FIG. 3*f* shows a conventional blower without slits. The external size of all of these blowers is 60 mm×60 mm×25.5 mm.

In these blowers, the flow rate $Q_s$ of air flowing in through the slits is regulated by changing the width w of slit and the number of slits n, so that setting is made such that the air flow of ratios of about 27.0%, 29.5%, 35.5%, 41.7%, and 48.5% of the maximum air flow is sucked through the slits in a state in which the static pressure is zero.

The width w of slit and the number of slits n of each blower, and the flow rate $Q_s$ of air flowing in through the slits are as given in the table shown in FIG. 4.

Figure 5:
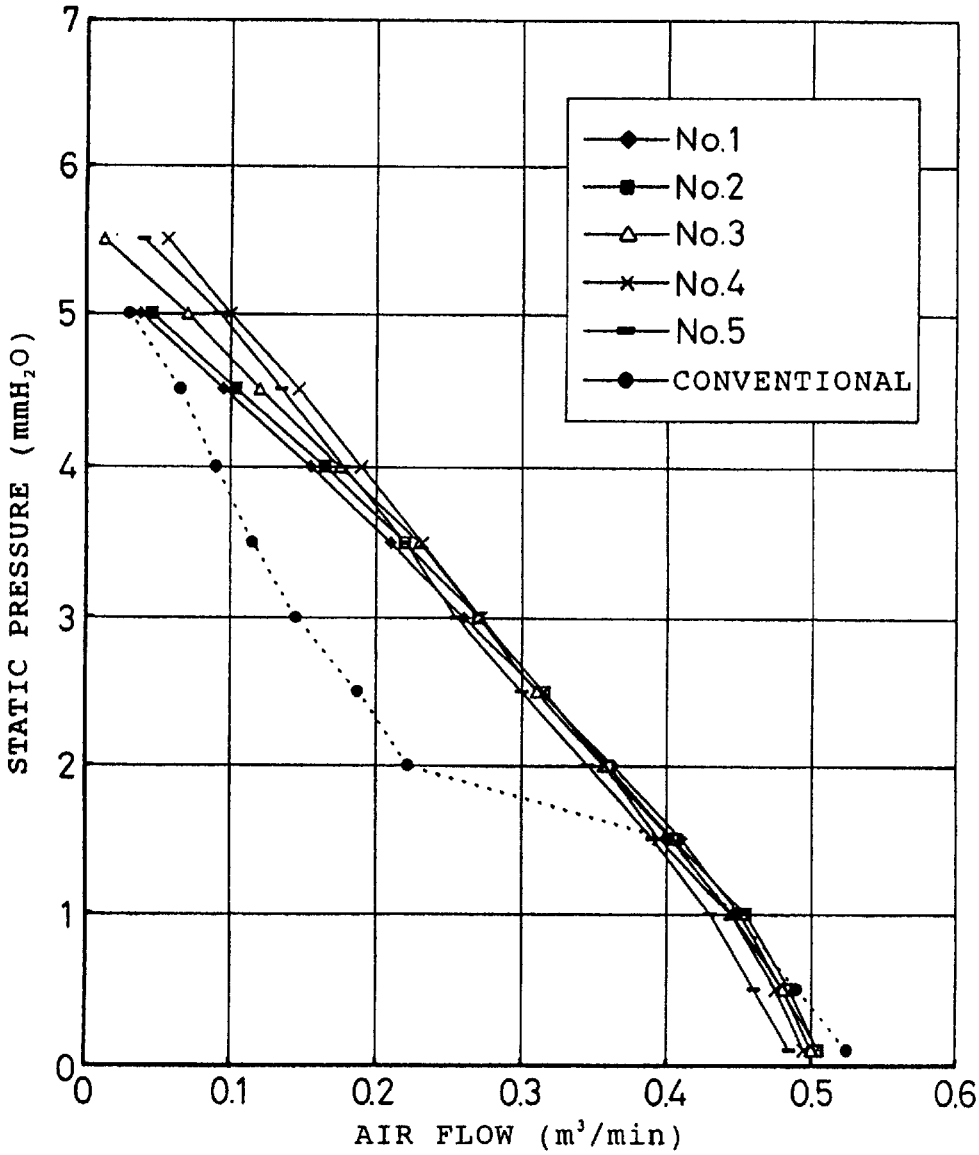
FIG. 5 is an air flow vs. static pressure characteristic diagram of the samples and the conventional blower without slits.
Figure 6:
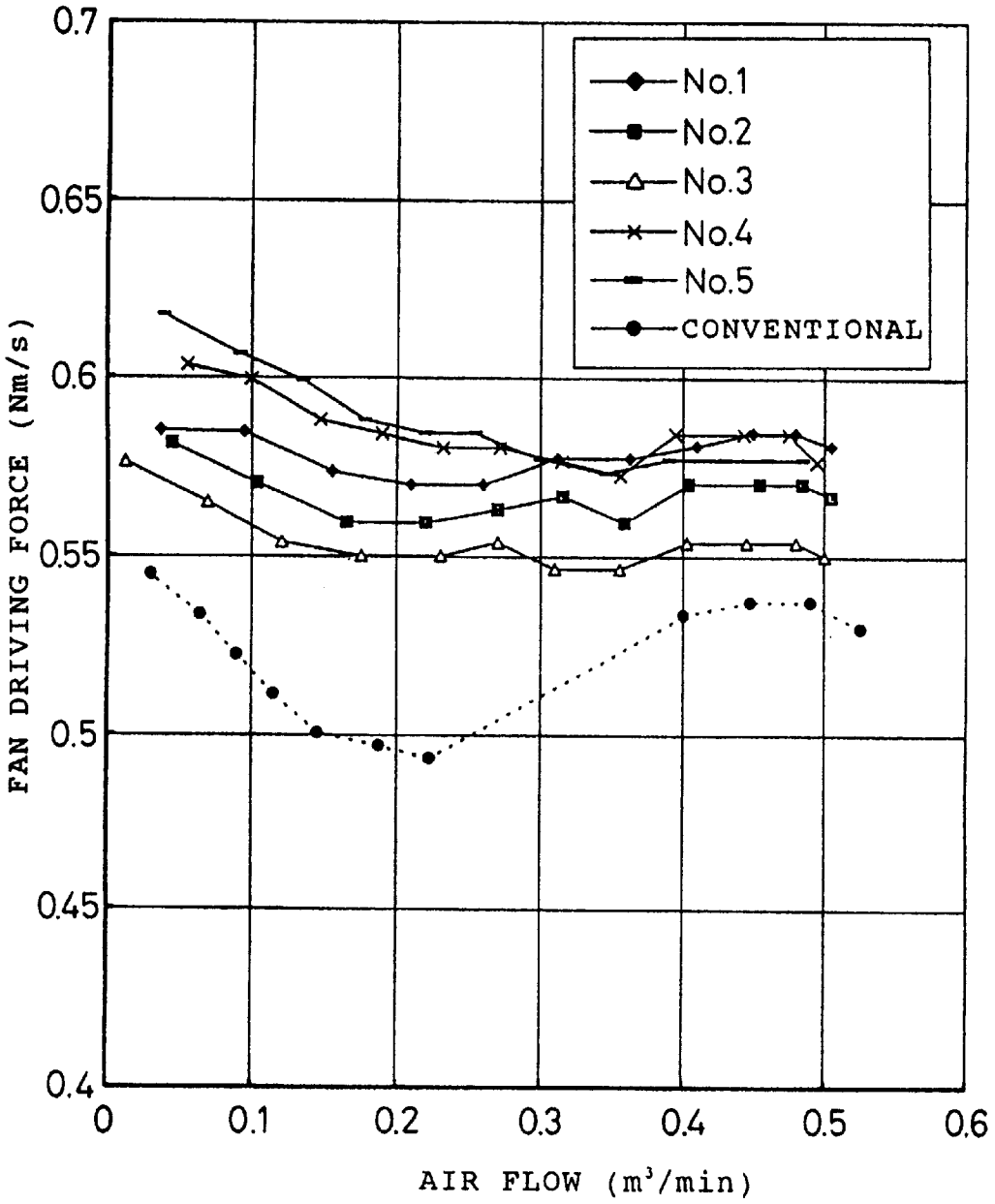
FIG. 6 is an air flow vs. fan driving force characteristic diagram of the samples and the conventional blower without slits.
Figure 7:
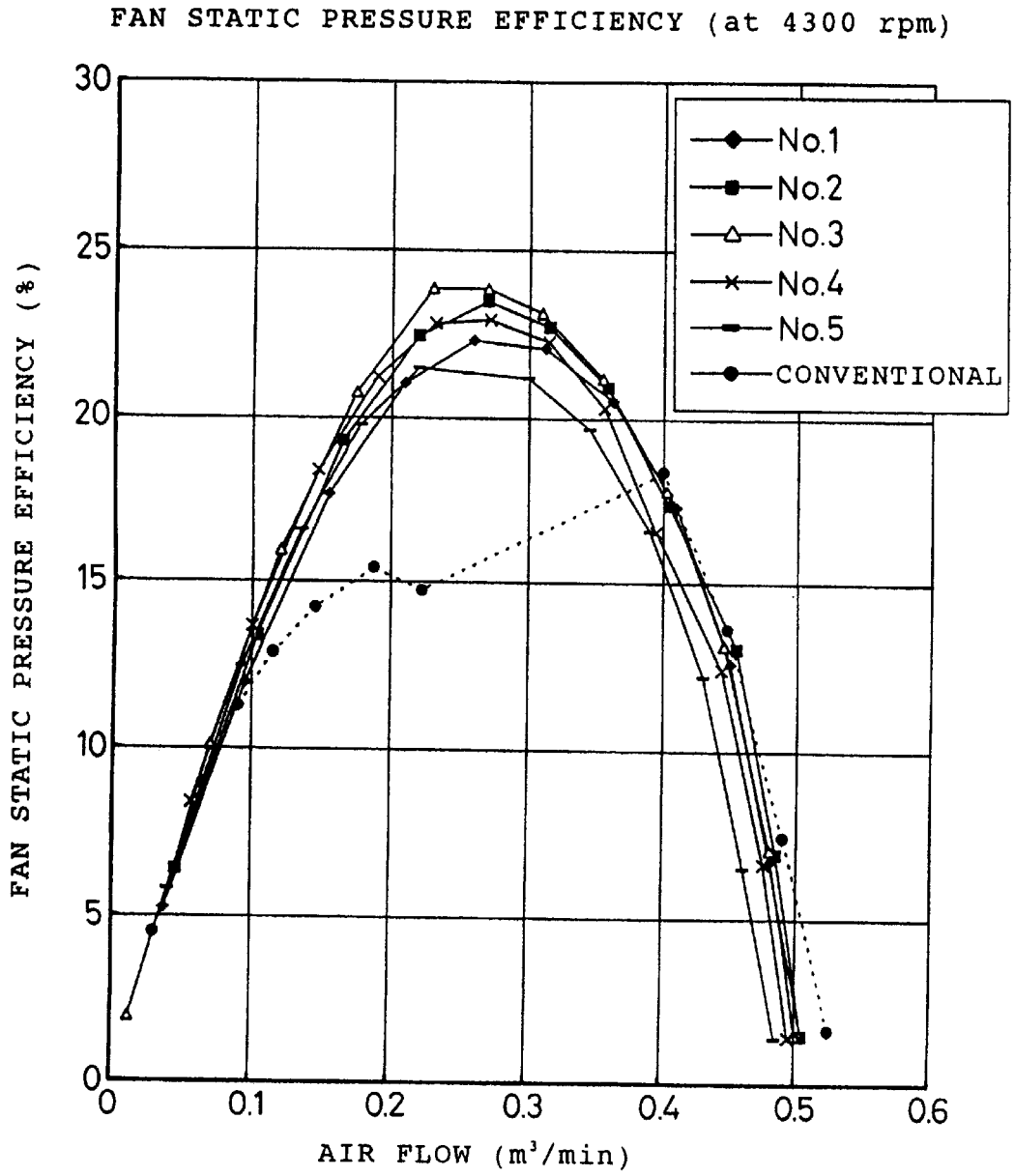
FIG. 7 is an air flow vs. fan static pressure efficiency characteristic diagram of the samples and the conventional blower without slits.

FIGS. 5 to 7 show the characteristics in the case where these blowers are driven at the same rotational speed.

FIG. 5 is an air flow vs. static pressure characteristic diagram for these blowers.

As shown in FIG. 5, these blowers have approximately equal maximum air flow, and have a tendency such that the air flow in the vicinity of the maximum static pressure decreases with decreasing the flow rate $Q_s$ of air flowing in through the slits.

The reason for this is that as the static pressure increases, the attack angle of blade increases and fan stall is prone to occur, so that the effect of inhibiting fan stall is lessened as the flow rate $Q_s$ of air flowing in through the slits decreases.

FIG. 6 is an air flow vs. fan driving force characteristic diagram for these blowers.

As shown in FIG. 6, the air flow vs. fan driving force characteristics are almost constant regardless of the air flow, and have a tendency to decrease as the flow rate $Q_s$ of air flowing in through the slits decreases. This is because the blower in which the flow rate $Q_s$ of air flowing in through the slits is decreased has a low energy loss $W_{loss}$ due to viscosity yielded in the slit, so that the fan driving force decreases at the same rotational speed.

FIG. 7 is an air flow vs. fan static pressure efficiency characteristic diagram for these blowers.

As shown in FIG. 7, the peak value of the air flow vs. fan static pressure efficiency curve, that is, the maximum efficiency is the highest in the case of No. 3 blower, in which the ratio of the flow rate $Q_s$ of air flowing in through the slits to the maximum air flow is 35.5%.

Also, it is found that there is a tendency for the operation point at the time of the maximum efficiency to shift to lower pressure as the flow rate $Q_s$ of air flowing in through the slits is decreased. This is because the blower in which the flow rate $Q_s$ of air flowing in through the slits is decreased compensates poor air flow vs. static pressure characteristics at high pressures with a lower fan driving force.

Figure 8:
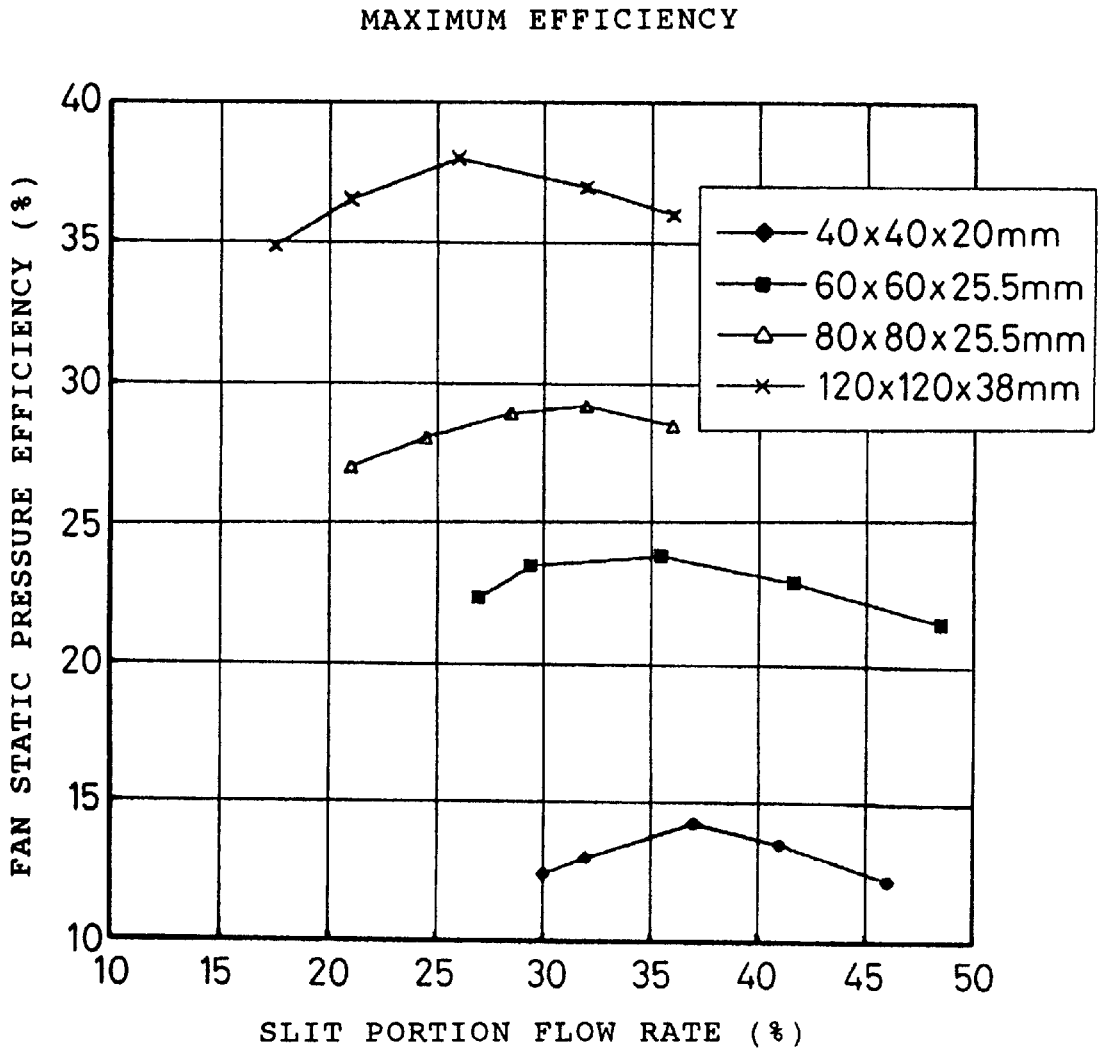
FIG. 8 is a slit portion viscosity loss vs. maximum efficiency characteristic diagram showing the relationship between the ratio of flow rate $Q_s$ of air flowing in through the slits to the maximum air flow and the maximum efficiency of a fan.
Figure 9:
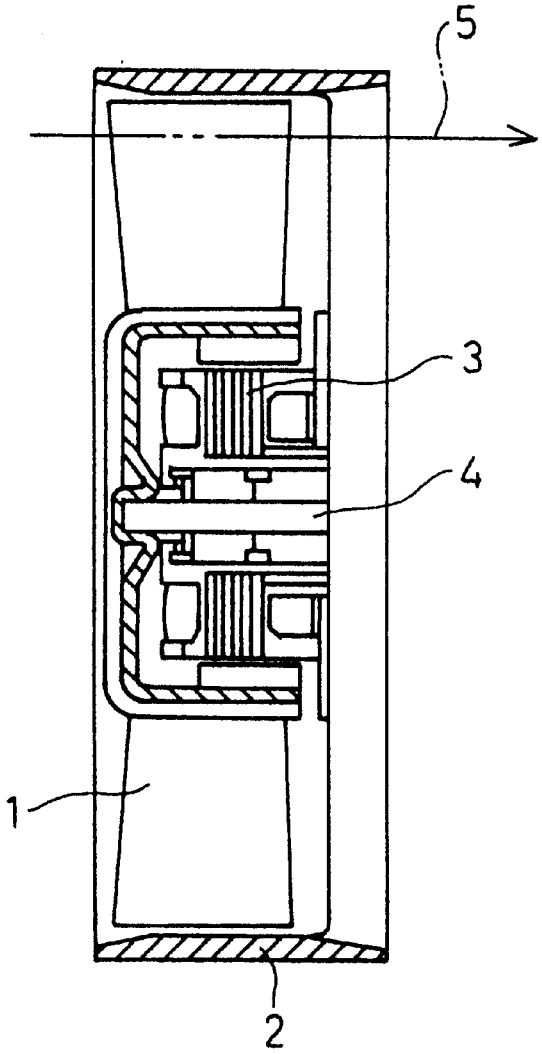
FIG. 9 PRIOR ART
FIG. 9 is a sectional view of a conventional axial blower.
Figure 10A:
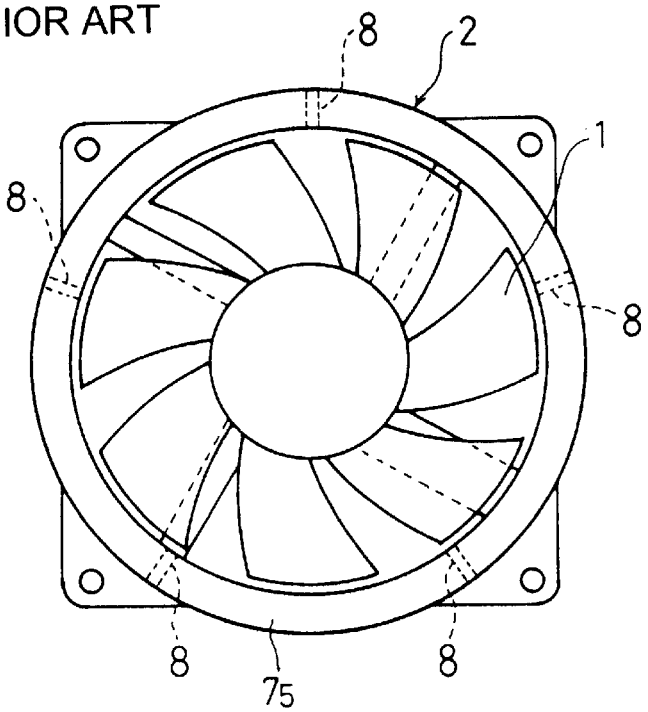
Fig.10a PRIOR ART
FIGS. 10*a*, 10*b*, and 10*c* are a front view, a side view, and a sectional view of a blower with slits, respectively.
Figure 10B:
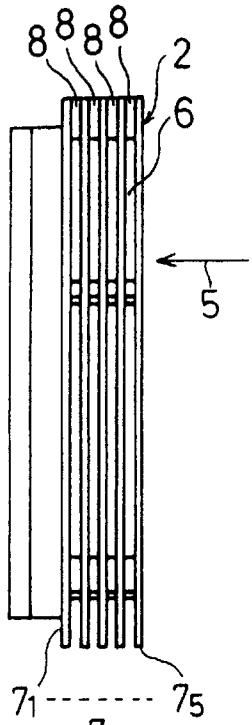
Fig.10b PRIOR ART
Figure 10C:
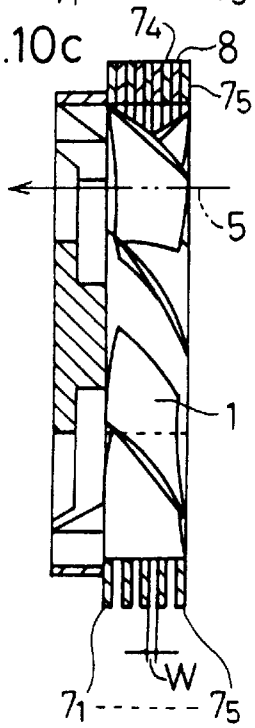
Fig.10c PRIOR ART
Figure 11:
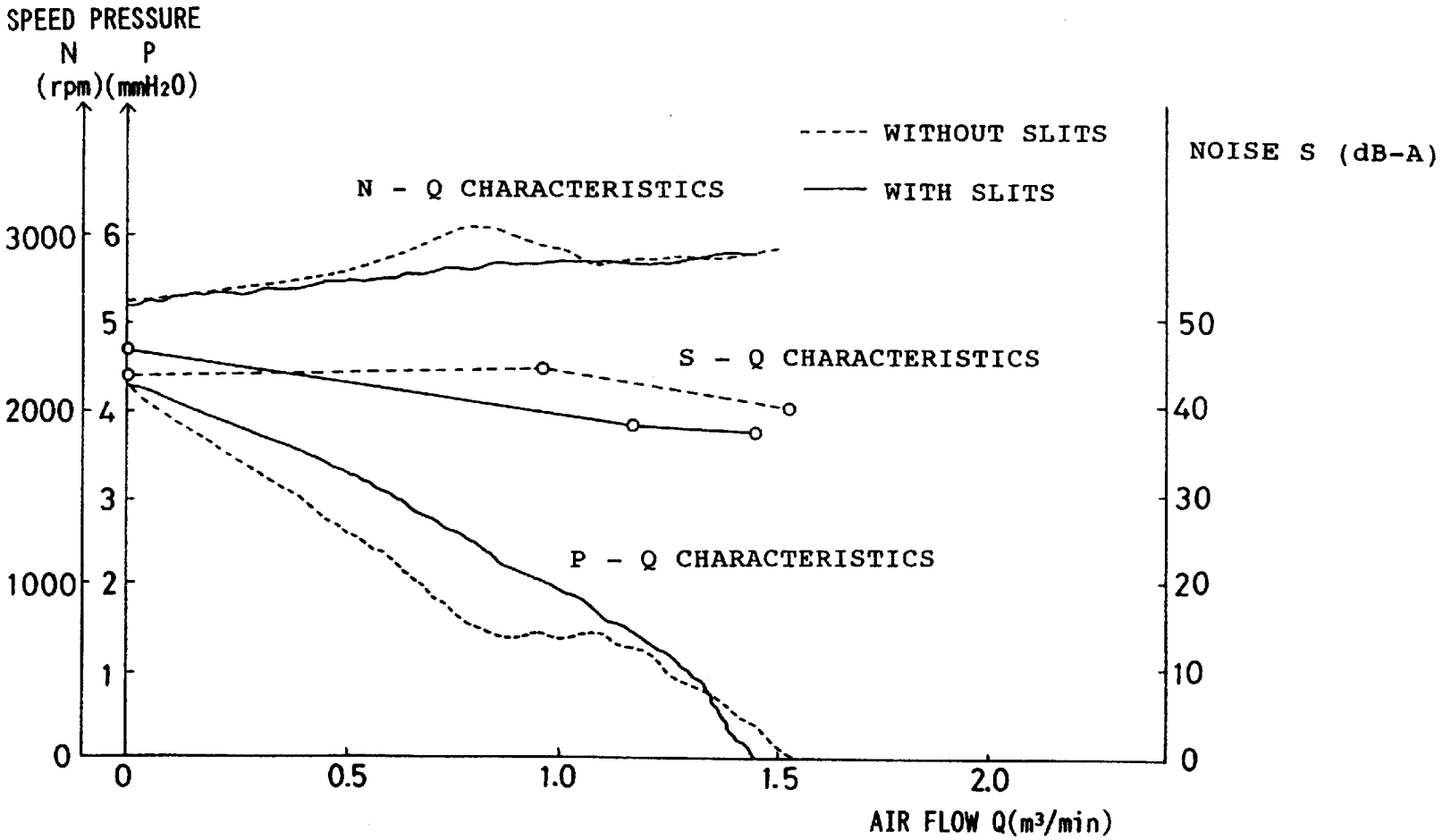
FIG. 11 PRIOR ART
FIG. 11 is an air flow vs. static pressure characteristic diagram of a conventional blower with slits.

FIG. 8 is a graph showing the relationship between the ratio of flow rate $Q_s$ of air flowing in through the slits to maximum air flow and the static pressure efficiency of the fan.

As shown in FIG. 8, it can be verified that there is a tendency for the efficiency to decrease even if the ratio of flow rate $Q_s$ of air flowing in through the slits to the maximum air flow moves to either side from the peak of about 35%.

No. 3 blower, in which the ratio of flow rate $Q_s$ of air flowing in through the slits to the maximum air flow is 35.5%, having the highest efficiency among the aforementioned blowers, achieves an increase in efficiency as high as about 30% as compared with the conventional blower having no slit in the annular wall.

In blowers of various external sizes from 40 mm×40 mm×20 mm to 120 mm×120 mm×38 mm on which experiments were carried out at the same time, when the flow rate of air flowing in through the slits is changed in the same manner, a point where the static pressure efficiency is at the maximum is present as shown in FIG. 8. The observed facts being put together, it was verified that in the blower with slits having an external size on which experiments were carried out, the efficiency can be maximized in a range of ratio of flow rate $Q_s$ of air flowing in through the slits to maximum air flow of 20 to 40%.

Therefore, in order to balance the fan stall inhibiting effect due to the air flow flowing in through the slits with the viscosity loss yielded in the slits, the ratio of flow rate $Q_s$ of air flowing in through the slits to maximum air flow must be 20 to 40% regardless of the shape of fan and the size of blower, etc.

If the flow rate $Q_s$ of air flowing in through the slits is decreased too much to decrease the viscosity loss $W_{loss}$ yielded in the slits, fan stall occurs, so that the air flow vs. static pressure characteristics are deteriorated, thereby extremely deteriorating the efficiency at load.

Inversely, if the flow rate $Q_s$ of air flowing in through the slits is increased too much, although fan stall is eliminated, the viscosity loss $W_{loss}$ yielded in the slits increases, so that the total efficiency of blower is lowered.

The conditions for making the ratio of flow rate $Q_s$ of air flowing in through the slits to maximum air flow 20 to 40% will mow be considered.

For a general axial blower, since the difference in air pressure Δp between inner and outer peripheries of annular wall is about 3 to 5% of the maximum static pressure $P_{max}$ of blower, the flow rate $Q_s$ of air flowing in through the slits has a relationship expressed, from Equation (4), as $$\frac{\pi \cdot D \cdot n \cdot w^5 \cdot 0.03 \cdot P_{\max}}{12\eta \cdot L} \leq Q_s \leq \frac{\pi \cdot D \cdot n \cdot w^3 \cdot 0.05 \cdot P_{\max}}{12\eta \cdot L} \quad (7)$$

Since the ratio of flow rate $Q_s$ of air flowing in through the slits to maximum air flow Qmax should be 20 to 40% (that is, $0.2Q_{max} \leqq Q_s \leqq 0.4Q_{max}$), taking the maximum air flow of blower as $Q_{max}$, by making setting so that a relationship of $$4.0 \leq \frac{\pi \cdot D \cdot n \cdot w^3 \cdot P_{\max}}{12\eta \cdot L \cdot Q_{\max}} \leq 13.3 \quad (8)$$

holds, the effect of inhibiting fan stall and the viscosity loss yielded in the slit are balanced, by which the most efficient blower of the same size can be provided.

For example, in case of a blower having an external size of 90 mm×90 mm×25.5 mm, when calculation is made by using the above equation, since the inside diameter D of annular wall is 86 mm (0.086 m), the length L in the radial direction of annular wall is 8 mm (0.008 m), the viscosity η of air is $18.2\times10^{-5}$ Pa·s, the maximum static pressure $P_{max}$ of blower is 40 Pa, and the maximum air flow $Q_{max}$ of blower is 0.025 $m^3/s$, when the number of slits n is taken as 4, by substituting the numerals into Equation (8), $$4.0 \leq \frac{3.14 \times 0.086 \times 4 \times w^3 \times 40}{12 \times 1.82 \times 10^{-5} \times 0.008 \times 0.025} \leq 13.3 \quad (9)$$

can be obtained. By rearranging, w is expressed as $$0.00159 \leqq w \leqq 0.0238 \quad (10)$$

That is to say, the width w of the gap of slit must be set in the range of 1.59 mm to 2.38 mm.

Also, when the blower is used by being incorporated in equipment, the consumed energy of blower is kept at the minimum under the same blowing conditions, by which the consumed energy of the whole equipment can be decreased. Also, when the consumed energy of blower is made equal, the blowing capacity of blower is increased, so that, an effect of, improving the cooling capacity of equipment can be achieved.

In the aforementioned No. 1 to No. 5 samples, the width of slit does not change in the radial direction. However, when the width of slit is changed in the radial direction to make the inflow resistance of every portion approximately equal over the whole circumference as in the case of a blower disclosed in the prior application (Japanese Patent Application No. 9-359593) filed by the same applicant as that of this invention, the same calculation as that of the above-described embodiment is performed although the calculation becomes somewhat complex. Finally, when the length of air flow direction from the inner periphery to the outer periphery of annular wall is taken as L, and the width of slit at a distance 1 from the inner periphery of the slit as w(1), by making setting so that a relationship of $$4.0 \leq \frac{\pi \cdot D \cdot n \cdot P_{\max}}{12\eta \cdot Q_{\max} \int_0^L \frac{1}{w(l)^3} dl} \leq 13.3 \quad (11)$$

holds, the ratio of flow rate $Q_s$ of air flowing in through the slits to maximum air flow becomes 20 to 40%, so that the effect of inhibiting fan stall and the viscosity loss yielded in the slit are balanced, by which the most efficient blower of the same size can be provided.

As described above, according to the configuration of the present invention, the effect of inhibiting fan stall due to the air flow through the slits and the energy loss due to viscosity of air yielded in the slit are balanced, by which the efficiency of blower can be improved.

What is claimed is:

1. A blower having an annular wall spaced from a blade tip end of a fan and at least one slit formed in a portion opposed to the blade tip end of the annular wall for communication between inner and outer peripheral portions of the annular wall so that air is sucked to the inner peripheral portion of the annular wall through the slit as the fan rotates, wherein the width and the number of slits are so set that an air flow of 20 to 40% of the maximum air flow is sucked through the slits in a state in which the static pressure is zero.

2. The blower according to claim 1, wherein when the viscosity of air is taken as η, the inside diameter of the annular wall as D, the radial-directional length of each slit as L, the width of each slit as a constant value of w, the number of slits as n, the maximum static pressure of the blower as $P_{max}$, and the maximum air flow of the blower as $Q_{max}$, the width and the number of slits are set so that the relationship between these particulars satisfies the condition of $$4.0 \leq \frac{\pi \cdot D \cdot w^3 \cdot P_{\max}}{12\eta \cdot L \cdot Q_{\max}} \leq 13.3.$$

3. The blower according to claim 1, wherein when the viscosity of air is taken as η, the inside diameter of the annular wall as D, the radial-directional length of each slit as L, the width of each slit at a distance 1 from the inner periphery of the slit as w(1), the number of slits as n, the maximum static pressure of the blower as $P_{max}$, and the maximum air flow of the blower as $Q_{max}$, the width and the number of slits are set so that the relationship between these particulars satisfies the condition of $$4.0 \leq \frac{\pi \cdot D \cdot n \cdot P_{\max}}{12\eta \cdot Q_{\max} \int_0^L \frac{1}{w(l)^3} dl} \leq 13.3.$$

4. A method for determining a slit shape for a blower having an annular wall spaced from a blade tip end of a fan and a slit formed at a portion opposed to the blade tip end of the annular wall for communication between inner and outer peripheral portions of the annular wall so that air is sucked to the inner peripheral portion of the annular wall through the slit as the fan rotates, wherein the shape of the slit is so determined that an air flow of 20 to 40% of the maximum air flow is sucked through the slit in a state in which the static pressure is zero.

5. The method for determining a slit shape for a blower according to claim 4, wherein when the viscosity of air is taken as η, the inside diameter of the annular wall as D, the radial-directional length of the slit as L, the width of the slit as a constant value of w, the number of slits as n, the maximum static pressure of the blower as $P_{max}$, and the maximum air flow of the blower as $Q_{max}$, the shape of the slit is determined so that the relationship between these particulars satisfies the condition of $$4.0 \leq \frac{\pi \cdot D \cdot w^3 \cdot P_{\max}}{12\eta \cdot L \cdot Q_{\max}} \leq 13.3.$$

6. The method for determining a slit shape for a blower according to claim 4, wherein when the viscosity of air is taken as η, the inside diameter of the annular wall as D, the radial-directional length of the slit as L, the width of the slit at a distance 1 from the inner periphery of the slit as w(1), the number of slits as n, the maximum static pressure of the blower as $P_{max}$, and the maximum air flow of the blower as $Q_{max}$, the shape of the slit is determined so that the relationship between these particulars satisfies the condition of $$4.0 \leq \frac{\pi \cdot D \cdot n \cdot P_{\max}}{12\eta \cdot Q_{\max} \int_0^L \frac{1}{w(l)^3} dl} \leq 13.3.$$

* * * * *